US008353445B2

(12) United States Patent
Lohse

(10) Patent No.: US 8,353,445 B2
(45) Date of Patent: Jan. 15, 2013

(54) STORAGE AND TRANSPORT CONTAINER

(75) Inventor: Uwe Lohse, Freiberg (DE)

(73) Assignee: montara Verpacken mit System GmbH, Grossschirma (DE)

( * ) Notice: Subject to any disclaimer, the term of this patent is extended or adjusted under 35 U.S.C. 154(b) by 117 days.

(21) Appl. No.: 12/943,468

(22) Filed: Nov. 10, 2010

(65) Prior Publication Data

US 2012/0061277 A1 Mar. 15, 2012

(30) Foreign Application Priority Data

Sep. 14, 2010 (DE) ..... 10 2010 037 517

(51) Int. Cl.
*B65D 5/42* (2006.01)

(52) U.S. Cl. ..... 229/199; 229/918; 229/919; 220/642; 206/504

(58) Field of Classification Search ..... 220/62–62.1, 220/612, 752; 229/125.27, 125.36, 148–149, 229/199, 915, 918–919; 206/504, 509
See application file for complete search history.

(56) References Cited

U.S. PATENT DOCUMENTS

| | | | | |
|---|---|---|---|---|
| 2,544,283 | A | 3/1951 | Snyder | |
| 3,584,757 | A * | 6/1971 | Blaisdell | 220/4.28 |
| 5,295,632 | A * | 3/1994 | Zink et al. | 229/198 |
| 5,492,267 | A * | 2/1996 | Hollander et al. | 229/231 |
| 6,592,025 | B2 * | 7/2003 | Bazany et al. | 229/199 |
| 6,619,540 | B1 * | 9/2003 | Bazany | 229/199 |
| 7,836,876 | B2 * | 11/2010 | Schellenberg | 126/268 |
| 2008/0135560 | A1 * | 6/2008 | Dominski et al. | 220/507 |

FOREIGN PATENT DOCUMENTS

| | | |
|---|---|---|
| DE | 29517978 | 1/1996 |
| EP | 0674595 | 10/1995 |

* cited by examiner

*Primary Examiner* — Luan K Bui
*Assistant Examiner* — Brijesh Patel
(74) *Attorney, Agent, or Firm* — Jordan and Hamburg LLP

(57) ABSTRACT

Provided is a stackable storage and transport container for storing and for single-use or multiple-use transport of goods, especially small parts. The container is assembled from a foldable container blank having a bottom, two side walls foldable about a fold, two end walls foldable about a fold, and four corner flaps foldable inward against the side walls or end walls about a fold. Tabs are formed on the side walls and end walls such that they can fold laterally against the intermediate pieces. A stackable profile having a hook edge is placed about the upper edge to provide for the stacking of a number of containers. The container blank preferably is made of a plastic hollow sheet.

10 Claims, 5 Drawing Sheets

STORAGE AND TRANSPORT CONTAINER

BACKGROUND OF THE INVENTION

The invention relates to a stackable storage and transport container for storing and for single-use or multiple-use transport of goods of all types, especially small parts.

Cargo containers are particularly used as transport and storage containers when tools or components for a manufacturing process must be transported or placed in temporary storage. They generally comprise sheet metal or plastic sheets that can be joined to one another by gluing, welding, or in a positive fit. In addition to having adequate carrying capacity and service life, it is also important that, to the extent possible, the containers have no projections or shoulders that can constrict the interior, or otherwise present other obstructions. In some cases, additional inserts are provided in the interior that completely line the interior without any projections, but they themselves do not have sufficient carrying capacity and they involve additional complexity.

EP 0 674 595 B1 describes a stackable transport container with a self-locking top rail. The container comprises a uniformly thick, foldable container blank having a bottom, two upright end walls, two upright side walls, and four end flaps. The side walls and end walls have tabs folded downward over which is placed a top rail that automatically locks on the tabs.

DE 295 17 978 U1 discloses a cargo container in which the side walls are hollow sheets made of thermoplastic material. The upper edges of the side walls are provided with a turned edge that is integrally molded on the side walls and formed by a rigid fold in the hollow sheet, forming a circumferential hollow space. The lower end of the turned edge is separated from the side walls by an open gap. The side walls are held together in a positive fit on the sides and corners by means of connecting parts using edge, fold, and side connectors. The disclosed cargo container has a complicated structure with numerous projections and edges and shoulders. It is complicated to produce because of the many individual parts.

U.S. Pat. No. 2,544,283 A describes a transport container from a folded blank. It possesses an upper edge having a lip on the bottom side that engages in the side flaps of the upright container. The edge comprises two areas that are held by connection clamps.

The disadvantage of the aforesaid transport containers is that their production and engineering are very complex because of the thermal edges. When using hollows sheets, if a single score ("kiss cut") is used or when an integral hinge is used, the restoring force of the hollow sheet material has a negative effect on the circumferential stacking profile in that the hollow sheet material spreads. In addition, the complexity for the material increases because of the additional downwardly foldable tabs that are disposed along the side walls.

SUMMARY OF THE INVENTION

The object of the invention is to provide a storage and transport container that is lower in weight but that has good stability and as few projections and shoulders as possible. In addition it should be simple and cost-effective to produce.

The storage and transport container comprises one integral and foldable container blank. The container blank has a bottom, two side walls that can be folded about a fold, two end walls that can be folded about a fold, and four corner flaps that can be folded inward against the side walls or end walls about a fold. In a rectangular storage and transport container, the side walls are arranged on the longer sides. When the cross-section is square, it does not matter which is called the side wall and which is called the end wall. The four corner flaps can also be disposed on the end walls. Two of the corner flaps should always advantageously be long enough that in the folded, upright condition they are equal in length to the entire side length that they cover. Consequently, they should always be arranged on the longer wall. Since this provides twice the material thickness on the end sides, it is advantageous when any grips are also provided on this side. This attains good stability and high carrying capacity.

The folds can be provided in the blank material by one or more of fluting, stamping, rolling and scoring. A plotter that produces the contours of the entire container blank is preferably used.

When producing the contours of the container blank, tabs are formed at the upper edge of the upwardly foldable side walls and/or at the upwardly foldable end walls. The number and dimensioning of the tabs depends on the desired carrying capacity of the storage and transport container.

The tabs are cut through on the lower tab edge; that is, the edge that is closest to the container bottom. Also, the tabs are cut through on one of the two vertically extending sides. The other of the two vertically extending sides is provided with a score or at least a fold so that the tabs can be folded laterally about the score, allowing for the positioning of the tabs against the intermediate pieces between the tabs. The tabs can be folded inward and outward. However, inward folding provides a container with additional complexity and disadvantages, because the container blank would first have to be turned and scored on the back side.

The width of a tab should preferably be equal to the width of an intermediate piece between the tabs, i.e., the width of a portion between the tabs that is in tact.

For purposes of symmetry, two tabs can be provided in which a cut or score divides the two tabs and at peripheral ends the tabs are provided with folds, and thus the tabs open laterally, like a window.

A stacking profile that is downwardly open is placed about the upper edge. Some sections of the upper edge are provided with twice the thickness of the folded tabs which effectively doubles the blank material present along parts of the upper edge.

The stacking profile has, in cross section, a U-shape provided by two legs; that is, an inner leg and an outer leg joined at a top surface, and a hook edge molded on the inside of the outer leg at a lower side thereof. The hook edge is selectively positioned on the outer leg so that when the stacking profile is placed on the upper edge of the container, the hook edge extends under the lower edge of the tabs and engages with same. The hook edge can be provided at an upward incline an angle $\alpha<90°$. The stacking profile snaps in over the edge of the upright side and end walls and is held securely.

For good stackability of a plurality of containers, the stacking profile can have a stacking edge.

For a high carrying capacity, a plurality of the tabs or even all of the tabs can be joined flat to the intermediate pieces against which they are folded. This can occur for instance using an adhesive to glue the tabs to the intermediate pieces. It is particularly advantageous when the container blank comprises a thermoplastic material and the tabs are welded to the intermediate pieces. Both surfaces are exposed to hot air until their surfaces liquefy and fuse together. This produces a durable and strong connection.

It is particularly advantageous when the container blank comprises plastic hollow sheet. Plastic hollow sheet comprises two outer walls spaced from one another and ribs or honeycomb structures disposed therebetween. When using a plastic hollow sheet, the folds are added on the wall side disposed interiorly in the container and thus a target buckling point is produced. On the outside, the container is just folded at the folding points and thus closed. This results in a closed container without sharp edges.

With hollow sheets, the score is formed on the tabs in that the interior sheet wall and the ribs or honeycomb structures are cut through so that it is easy to manually fold the tabs about the lateral edge.

Depending on the desired strength, it is also possible for a storage and transport container to comprise corrugated cardboard or aluminum honeycomb material, either completely or in part.

DETAILED DESCRIPTION OF THE INVENTION

The described exemplary embodiment is a preferred variant of a container for storing and transporting small parts for automobile production. The finished storage and transport container should have a size of 800×600×250 (L×W×H in mm).

Figure 1:
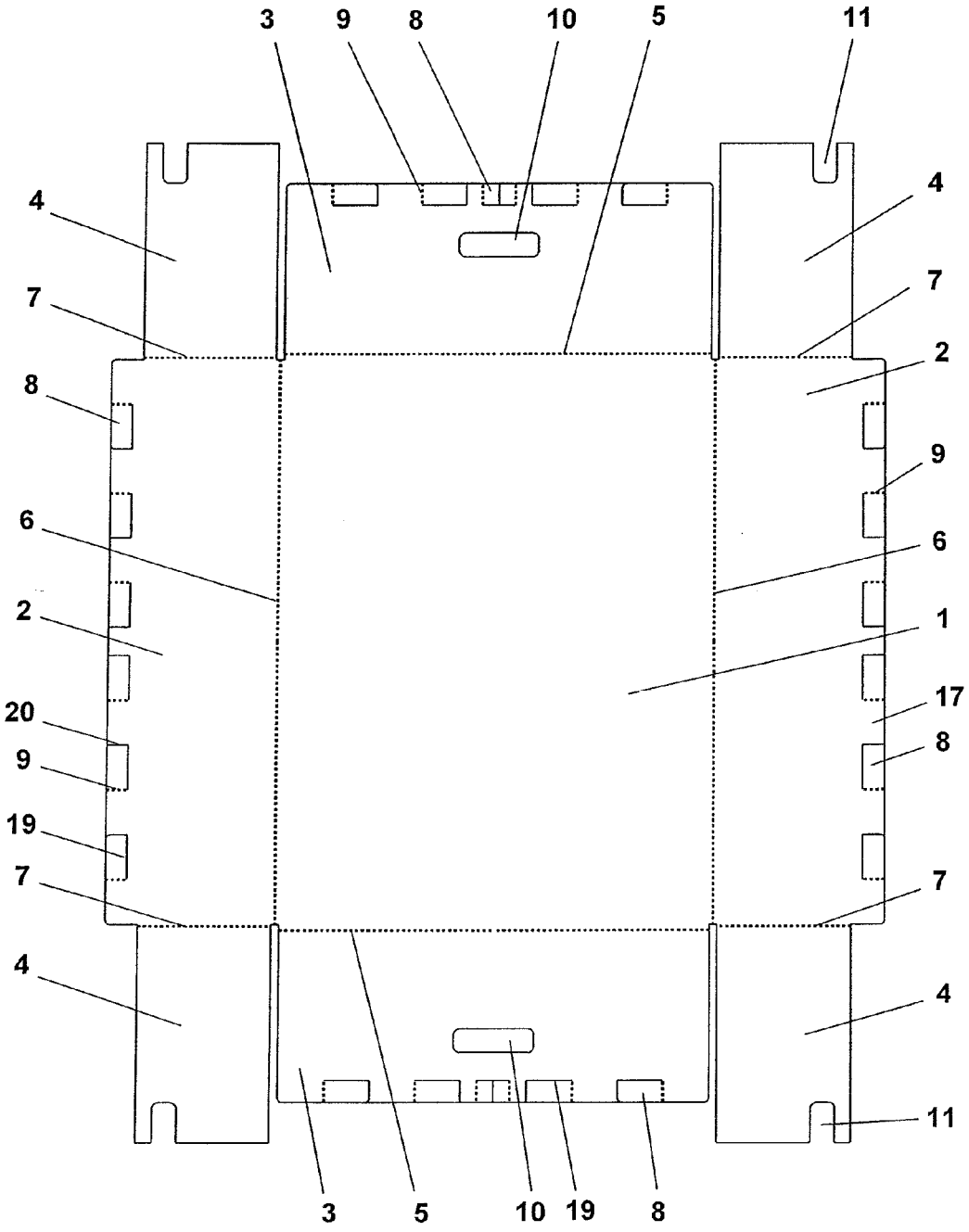
FIG. 1 is a top view of a container blank.

FIG. 1 is a top view of a container blank comprising a one-piece, 5-mm thick plastic hollow sheet. A contour is produced by means of a plotter, creating a bottom 1, two side walls 2 that can be folded about a fold 6, and two end walls 3 that can be folded about a fold 5. Two corner flaps 4 that can be folded inward about a fold 7 are formed on each of the two side walls 2. It is important that all of the edges are parallel. The corner flaps 4 are long enough that when they are folded in the assembled condition they cover the width of the end wall 3. There are notches 11 on the corner flaps 4 for grips 18 that can be inserted later. Grip openings 10 are also included in each of the two end walls 3. The folds 5, 6, 7 are also added in using the plotter.

Formed from the upper edge of the upwardly foldable side walls 2 and the upwardly foldable end walls 3 are six sidewall tabs 8 on each sidewall and five end wall tabs 8 on each end wall, respectively.

Tabs 8 are cut through on the lower bottom edge 19 and on one of each of the two vertically extending edges 20. The second vertically extending edge has a score 9 so that the tabs 8 can be folded laterally outward about the score 9 against the intermediate pieces 17 that are located between the tabs 8. The width of the tabs 8 is equal to the width of one intermediate piece 17. For reasons of symmetry, the center tabs 8 on the end walls 3 are folded in opposite directions.

The height of the side walls is higher than the height of the corner flaps by the width of the tabs. This can also be seen in FIG. 6.

Figure 2:
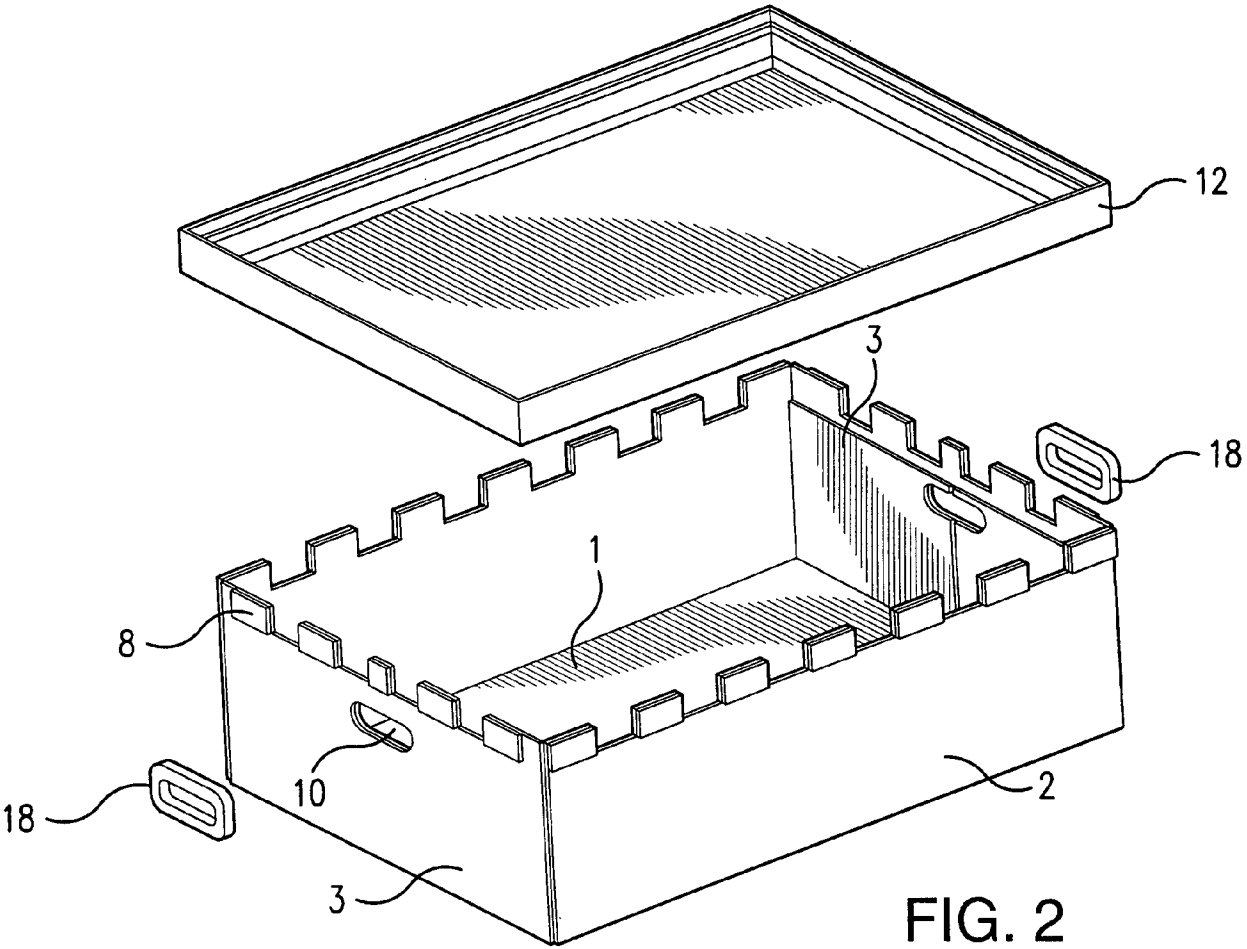
FIG. 2 depicts the individual parts of the storage and transport container.

FIG. 2 depicts the individual parts of the storage and transport container with the container blank already folded into its assembled condition. Grips 18 are inserted into the two grip openings 10 and into the four notches 11 in the corner flaps. The grips 18 are embodied in two parts and have a circumferential groove that is twice as thick as the hollow sheet and that has a snap mechanism. The two grip halves are inserted into the grip openings 10 and snapped together. Inserting the grips holds the corner flaps 4 against the end walls 3 so that no additional detent is necessary.

Figure 3:
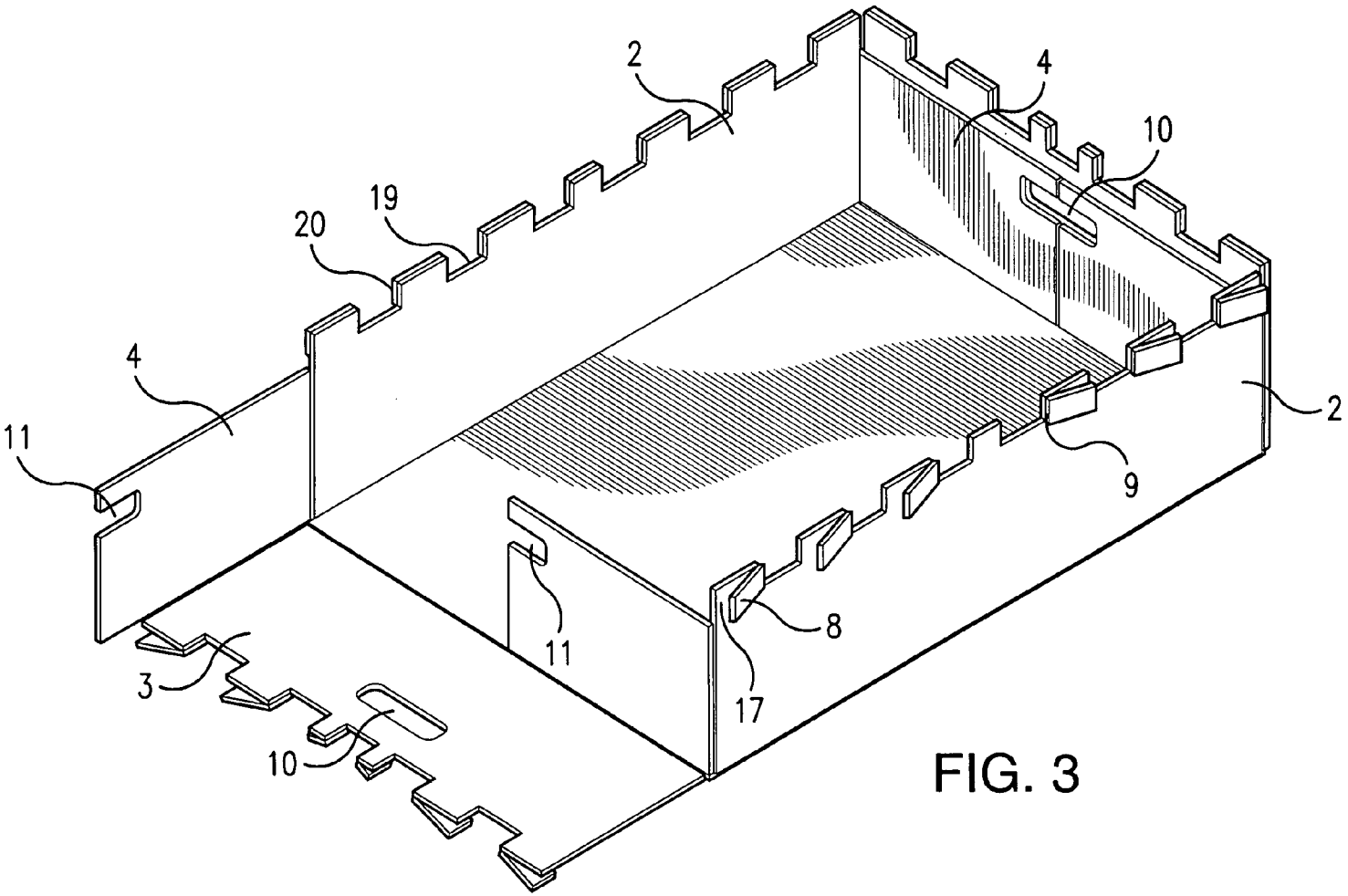
FIG. 3 depicts the container blank, partially folded into the assembled condition.

FIG. 3 depicts a container blank that has been partially folded into its assembled condition, and further shows the tabs 8 folded against the intermediate pieces 17. The score 9 on the tabs 8 is produced in that the interior sheet wall and the ribs or honeycomb structure are cut through. The outer sheet wall remains intact. It is possible for the latter to be scored, as well. This facilitates the manual bending of the tabs 8 about the sheet wall that remains intact. For high carrying capacity, all of the tabs 8 are welded to the intermediate pieces 17 using hot air.

Figure 4:
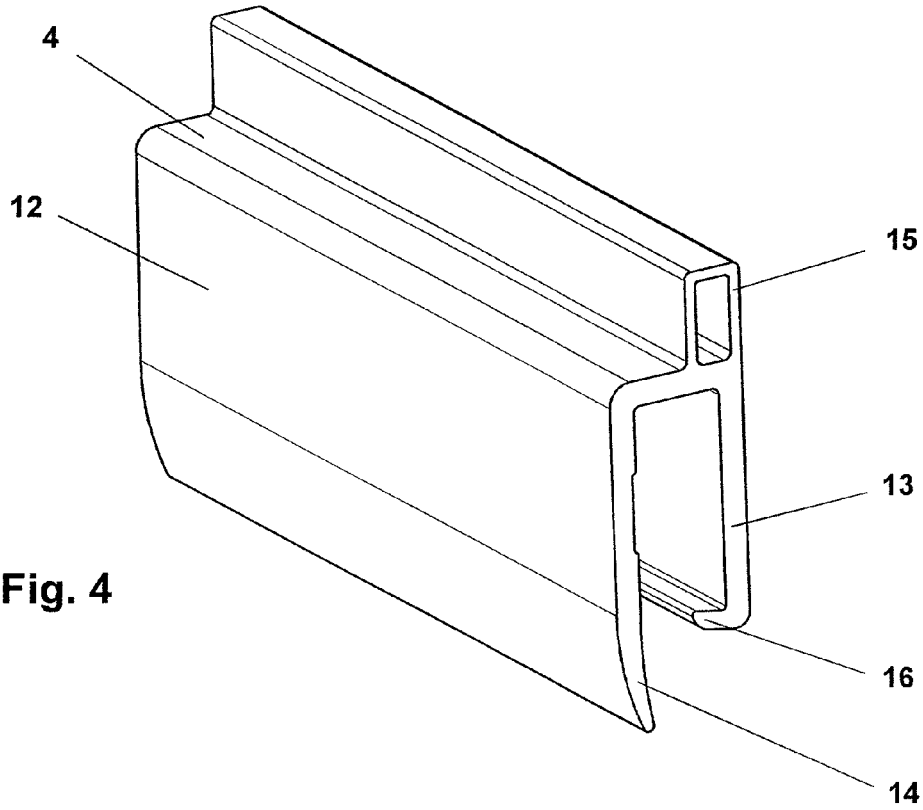
FIG. 4 is a perspective elevation of a stacking profile.
Figure 5:
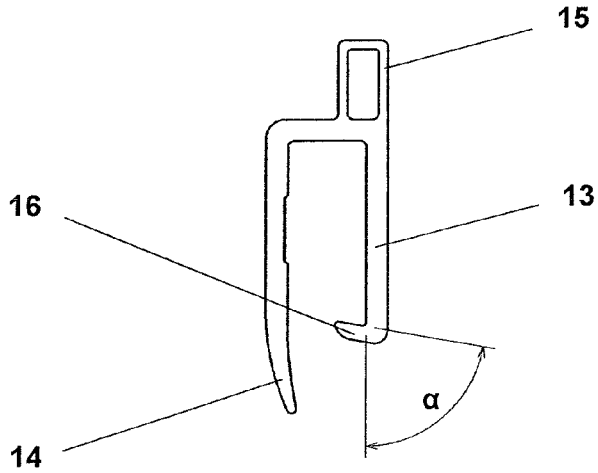
FIG. 5 is a section of a stacking profile.
Figure 6:
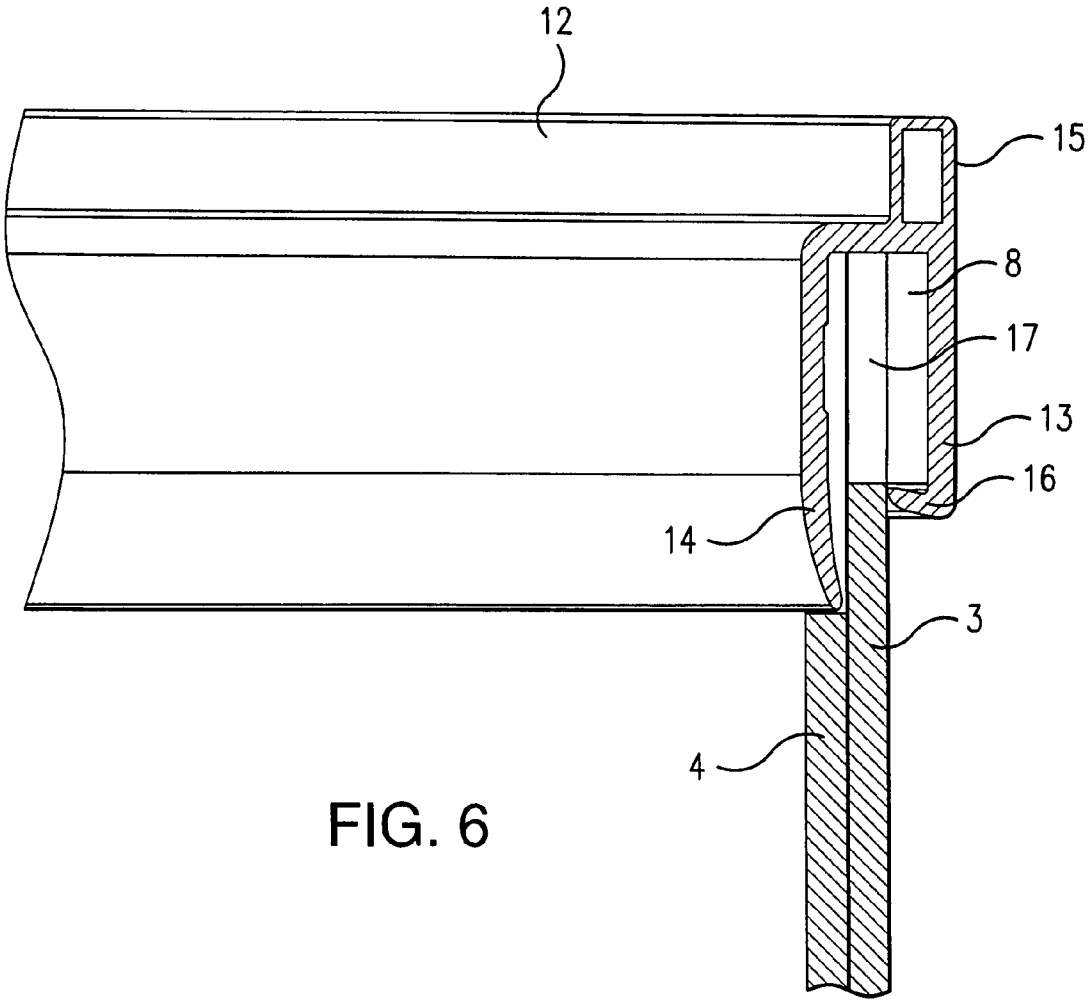
FIG. 6 is a section of a stacking profile on the box.

A stacking profile 12 that is open on the bottom is placed around the upper edge, which in sections is provided twice as thick because of the folded tabs 8. FIG. 4 and FIG. 5 depict stacking profile 12. FIG. 6 depicts stacking profile 12 in position on the container.

The stacking profile 12 is a plastic part and is provided with a U-shape. It has an inner leg 14 and an outer leg 13. A hook edge 16 is molded onto the inside of the outer leg 13. The hook edge 16 is attached at an elevation such that it reaches below the lower edge of the tabs 8 and engages there. The hook edge 16 is provided upwardly inclined at an angle of $\alpha=80°$. The inner leg 14 has a slight inward curvature. This enables slight spreading when the stacking profile 12 is positioned on the container. In addition, when the stacking profile 12 is positioned on the container, a tension is produced that ensures that the hook edge 16 is securely seated. Thus, the stacking profile 12 snaps over the edge of the upright side walls 2 and end walls 3.

The stacking profile 12 has a circumferential stacking edge 15 so that it is easy to stack a plurality of containers. The stacking edge 15 terminates on the outside and is wide enough on the inside for the next storage and transport container to be placed thereupon in a positive fit. The stacking edge 15 is embodied hollow to save material.

Because it has few components, the storage and transport container is low in weight but has good stability. It has few projections and shoulders. The container blank can be entirely plotted or punched. This enables precisely maintaining dimensional accuracy when plotting or punching so that low production tolerances are possible. The container can therefore be produced in a simple and cost-effective manner. Since no thermal edging is necessary, no thermal edging systems are required. High strength can be achieved using the novel flat fastening of the stacking edge to the tabs. The stacking profile is then locked without any restoring forces from tabs that are bent downward. This facilitates the mounting of the stacking profile and makes it more secure. Additional material for fastening edges is not needed.

The invention claimed is:

1. A storage and transport container formed by folding a foldable container blank in which the blank comprises a bottom, two side walls that can be folded about two sidewall folds, two end walls that can be folded about two endwall folds, four corner flaps in which each flap can be folded against one of the side walls and end walls about a fold between one of the sidewalls and endwalls, tabs formed in an upper edge of one or more of the two sidewalls and two endwalls, the tabs severed at bottom edges and at first vertical edges and being joined to the sidewalls and endwalls at a score provided on second vertical edges, the tabs being foldable about the second vertical edges to lie against intermediate wall portions located adjacent one or more tabs, the container comprising:

upon folding of the blank, a container bottom, two container sidewalls, two container end walls, and container tabs formed in an upper edge of the container sidewalls and endwalls that lie against intermediate container wall portions, the container being open on a top thereof; and a stacking profile positioned on the upper edge of the container sidewalls and endwalls of the container, comprising an inner leg opposing an outer leg across a cavity for receiving the upper edge of the container, and a hook edge molded on the inside of the outer leg, the hook edge of the stacking profile extending under the container tabs and engaging with the container tabs to secure the stacking profile on the upper edge of the container sidewalls and endwalls of the container.

2. The storage and transport container of claim 1, wherein at least some of the container tabs are joined to the intermediate container wall portions.

3. The storage and transport container of claim 2, wherein the container tabs are glued to the intermediate container wall portions.

4. The storage and transport container of claim 1, wherein the container comprises thermoplastic material and the container tabs are welded to the intermediate container wall portions.

5. The storage and transport container of claim 1, wherein the container tabs are provided with a width that is equal to a width of the intermediate container wall portions.

6. The storage and transport container of claim 1, wherein the container comprises a hollow plastic sheet.

7. The storage and transport container of claim 1, wherein the container comprises cardboard.

8. The storage and transport container of claim 1, wherein the container comprises aluminum material provided with a honeycomb structure.

9. The storage and transport container of claim 1, wherein the stacking profile has a partially circumferential stacking edge.

10. The storage and transport container of claim 1, wherein the hook edge extends inclined upward at an angle $\alpha<90°$.

* * * * *